US012421808B2

(12) United States Patent
Zhang et al.

(10) Patent No.: US 12,421,808 B2
(45) Date of Patent: Sep. 23, 2025

(54) DEVICES, SYSTEMS, AND METHODS FOR A REINFORCING RING IN A BIT

(71) Applicant: Schlumberger Technology Corporation, Sugar Land, TX (US)

(72) Inventors: Youhe Zhang, Spring, TX (US); Huimin Song, Spring, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/240,840

(22) Filed: Aug. 31, 2023

(65) Prior Publication Data

US 2024/0068302 A1 Feb. 29, 2024

Related U.S. Application Data

(60) Provisional application No. 63/374,099, filed on Aug. 31, 2022.

(51) Int. Cl.
*E21B 17/042* (2006.01)
*E21B 10/54* (2006.01)

(52) U.S. Cl.
CPC ..... *E21B 17/042* (2013.01); *E21B 10/54* (2013.01)

(58) Field of Classification Search
CPC ..... E21B 10/42; E21B 17/042
See application file for complete search history.

(56) References Cited

U.S. PATENT DOCUMENTS

| | | | | |
|---|---|---|---|---|
| 1,995,043 | A * | 3/1935 | Sanderson | E21B 10/40 175/413 |
| 3,709,306 | A * | 1/1973 | Curington | E21B 4/06 173/132 |
| 3,802,902 | A | 4/1974 | Turner | |
| 3,825,083 | A * | 7/1974 | Flarity | E21B 17/1092 175/325.2 |
| 4,505,343 | A * | 3/1985 | Hughes | E21B 17/04 175/425 |
| 5,441,121 | A * | 8/1995 | Tibbitts | E21B 10/52 175/417 |
| 6,945,338 | B1 * | 9/2005 | Defourny | E21B 17/076 175/101 |
| 7,703,556 | B2 * | 4/2010 | Smith | E21B 10/42 175/425 |
| 9,464,485 | B2 * | 10/2016 | Hellvik | E21B 17/07 |
| 10,704,333 | B2 | 7/2020 | Pan | |
| 11,220,868 | B2 * | 1/2022 | Zhang | F16L 15/008 |
| 11,459,830 | B2 | 10/2022 | Zhang | |
| 11,814,907 | B2 * | 11/2023 | Brooks | E21B 17/073 |

(Continued)

FOREIGN PATENT DOCUMENTS

| | | | |
|---|---|---|---|
| WO | 2016057076 | A1 | 4/2016 |
| WO | 2024232992 | A1 | 11/2024 |

*Primary Examiner* — Kenneth L Thompson
(74) *Attorney, Agent, or Firm* — Jeffrey D. Frantz

(57) ABSTRACT

In some aspects, the techniques described herein relate to a bit. The bit includes a bit head formed from a first material. A connection portion is connected to the bit head opposite the bit head. The connection portion has a box connection having an inner surface with a threaded connection for connection to a drill string. A reinforcing ring is formed from a second material. The reinforcing ring is located at the connection portion to strengthen the connection portion. The reinforcing ring is connected to the connection portion with an interlocking feature.

14 Claims, 10 Drawing Sheets

(56) References Cited

U.S. PATENT DOCUMENTS

| | | | | |
|---|---|---|---|---|
| 12,036,610 | B2 * | 7/2024 | Heng | B22F 5/00 |
| 2007/0102199 | A1 | 5/2007 | Smith | |
| 2014/0291033 | A1 * | 10/2014 | Amundsen | B23K 20/129 76/108.4 |
| 2018/0058148 | A1 | 3/2018 | Zhang | |
| 2022/0001444 | A1 | 1/2022 | Heng | |
| 2024/0068299 | A1 | 2/2024 | Zhang | |

* cited by examiner

DEVICES, SYSTEMS, AND METHODS FOR A REINFORCING RING IN A BIT

CROSS-REFERENCE TO RELATED APPLICATIONS

This patent application claims benefit of U.S. Provisional Patent Application Ser. No. 63/374,099 filed on Aug. 31, 2022, which is entirely incorporated herein by reference.

BACKGROUND OF THE DISCLOSURE

Downhole drilling equipment may be used to reach subterranean reservoirs of oil, natural gas, water, and other natural resources. Downhole drilling equipment may drill wellbores that extend up to tens of thousands of feet in length. To advance a wellbore, a bit having a plurality of cutting elements is used. The bit is connected to a drill string and is rotated to degrade the formation and increase the depth of the wellbore.

SUMMARY

In some aspects, the techniques described herein relate to a bit. The bit includes a bit head formed from a first material. A connection portion is connected to the bit head. The connection portion has a threaded connection for connection to a drill string. A reinforcing ring is formed from a second material. The reinforcing ring is located at the connection portion to strengthen the connection portion. The reinforcing ring is connected to the connection portion with one or more interlocking features.

In some aspects, the techniques described herein relate to a bit. The bit includes a bit head formed from a first material. A connection portion is connected to the bit head. A reinforcing ring is located in the connection portion to strengthen the connection portion. The reinforcing ring is formed from a second material. The reinforcing ring forms an inner surface having a threaded connection. The connection portion includes the first material on at least a portion of an outer surface of the reinforcing ring.

In some aspects, the techniques described herein relate to a method for forming a bit. The method includes preparing a mold for the bit. The mold includes a head portion and a connection portion. A reinforcing ring is placed in the connection portion. The mold is filled with a granular material. At least a portion of the granular material is in contact with the reinforcing ring. The granular material is infiltrated with an infiltrant.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a cross-sectional view of a bit having a reinforcing ring, according to at least one embodiment of the present disclosure;

FIG. 3-2 is a perspective view of the reinforcing ring of FIG. 3-1;

FIG. 5-1 is a cross-sectional view of a bit having a reinforcing ring, according to at least one embodiment of the present disclosure;

FIG. 5-2 is a perspective view of the reinforcing ring of FIG. 5-1;

FIG. 6-1 is a cross-sectional view of a bit having a reinforcing ring, according to at least one embodiment of the present disclosure;

FIG. 6-2 is a perspective view of the reinforcing ring of FIG. 6-1; and

DETAILED DESCRIPTION

This disclosure generally relates to devices, systems, and methods for a connection between a bit and a drill string. A bit includes a bit head and a connection portion located adjacent to the bit head. The connection portion may include a box connection to a drill string. A box connection is a threaded connection on an inner surface of the connection portion. The connection portion may include a reinforcing ring. The reinforcing ring may improve the strength of the connection between the bit and the drill string. For example, the bit head and the reinforcing ring may be formed from different materials. The bit head may be formed from a wear and/or erosion resistant material, and the reinforcing ring may be formed from a ductile material. The ductile material may help to strengthen threads of the connection portion to reduce wear and/or fracture of the connection portion. In this manner, the bit may have a stronger connection to the drill string, resulting in less damage and/or breaking of the bit.

Figure 1:
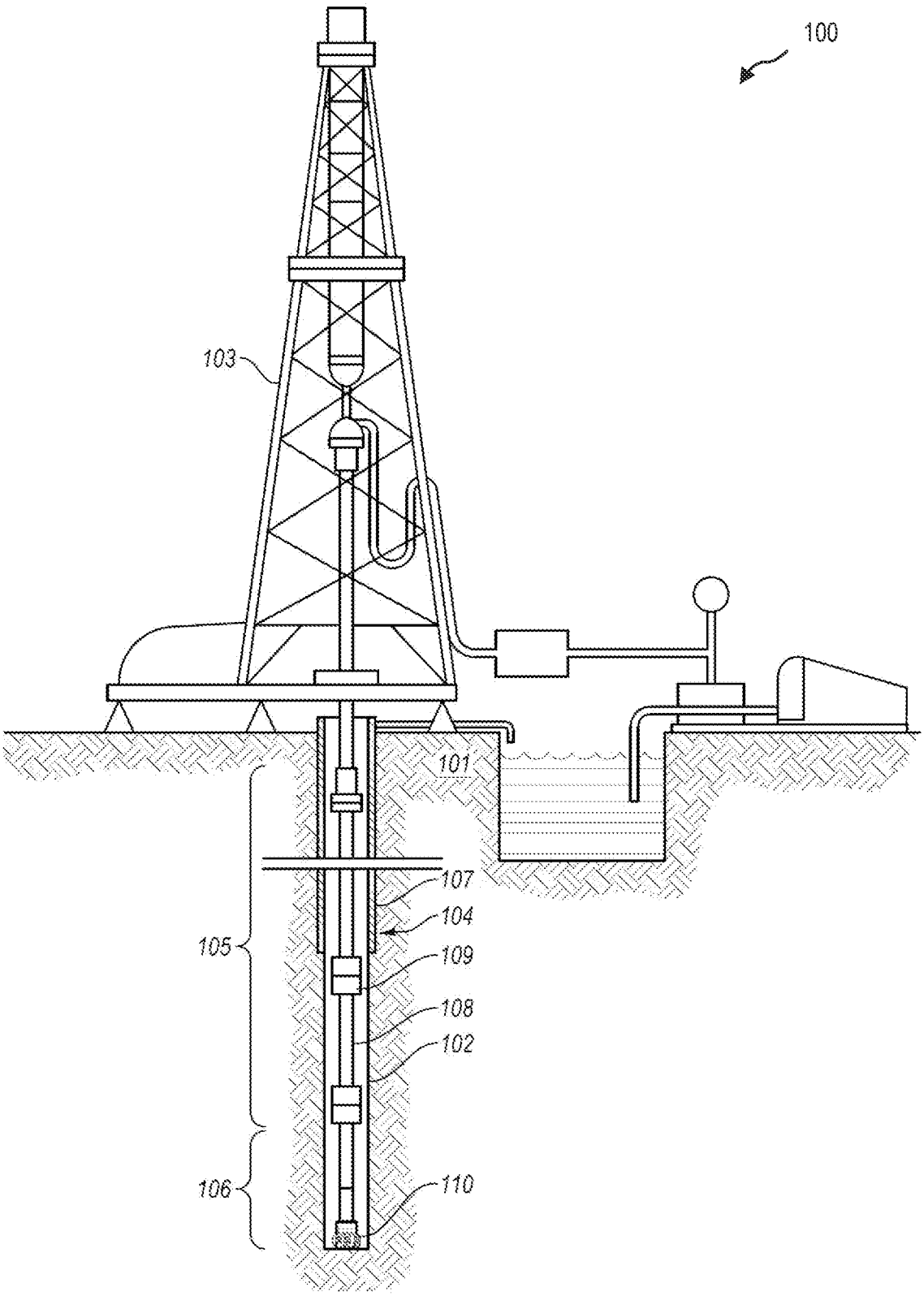
FIG. 1 is an illustration of a drilling system for drilling an earth formation to form a wellbore, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

As discussed herein, the bit 110 may be connected to the drill string 105 and/or the BHA 106 with a box and pin connection. A box and pin connection includes a pin connection with threads located on an outer surface of the pin connection. A box connection includes threads located on an inner surface of the box connection. The outer threads of the pin connection may be complementary to the inner threads of the box connection. In this manner, the bit 110 may be connected to the drill string 105.

In some embodiments, the bit 110 may include either a box connection or a pin connection. The drill string 105 or the BHA 106 may include either a box connection or a pin connection. For example, as discussed herein, the bit 110 may include a box connection and the drill string 105 and/or the BHA 106 may include a complementary pin connection. The bit 110 may be threaded onto the drill string 105 or the BHA 106. In some embodiments, the bit 110 may include a pin connection and the drill string 105 and/or the BHA 106 may include a complementary box connection.

During operation, the bit 110 may experience forces associated with drilling, such as torque from rotation of the drill string 105 and/or the BHA 106, impact of the bit 110 with the earth formation 101, any other forces, and combinations thereof. Forces may be transferred between the bit 110 and the drill string 105 and/or the BHA 106. These forces may be applied through the connection, such as the box and pin connections discussed herein. This may cause the connection to experience wear. In some embodiments, this may result in damage to the connection, the bit head, the bit 110, the drill string 105, and/or the BHA 106.

In accordance with at least one embodiment of the present disclosure, the bit 110 may include a reinforcing ring to strengthen the connection between the bit 110 and the drill string 105 and/or the BHA 106. The reinforcing ring may be formed from a different material than the rest of the bit 110. For example, the reinforcing ring may be formed from a more ductile material than the bit 110. This may help to reduce damage and/or breaking of the bit at the connection. In some embodiments, the threads of the connection of the bit 110 may be formed in the reinforcing ring.

Figure 2:
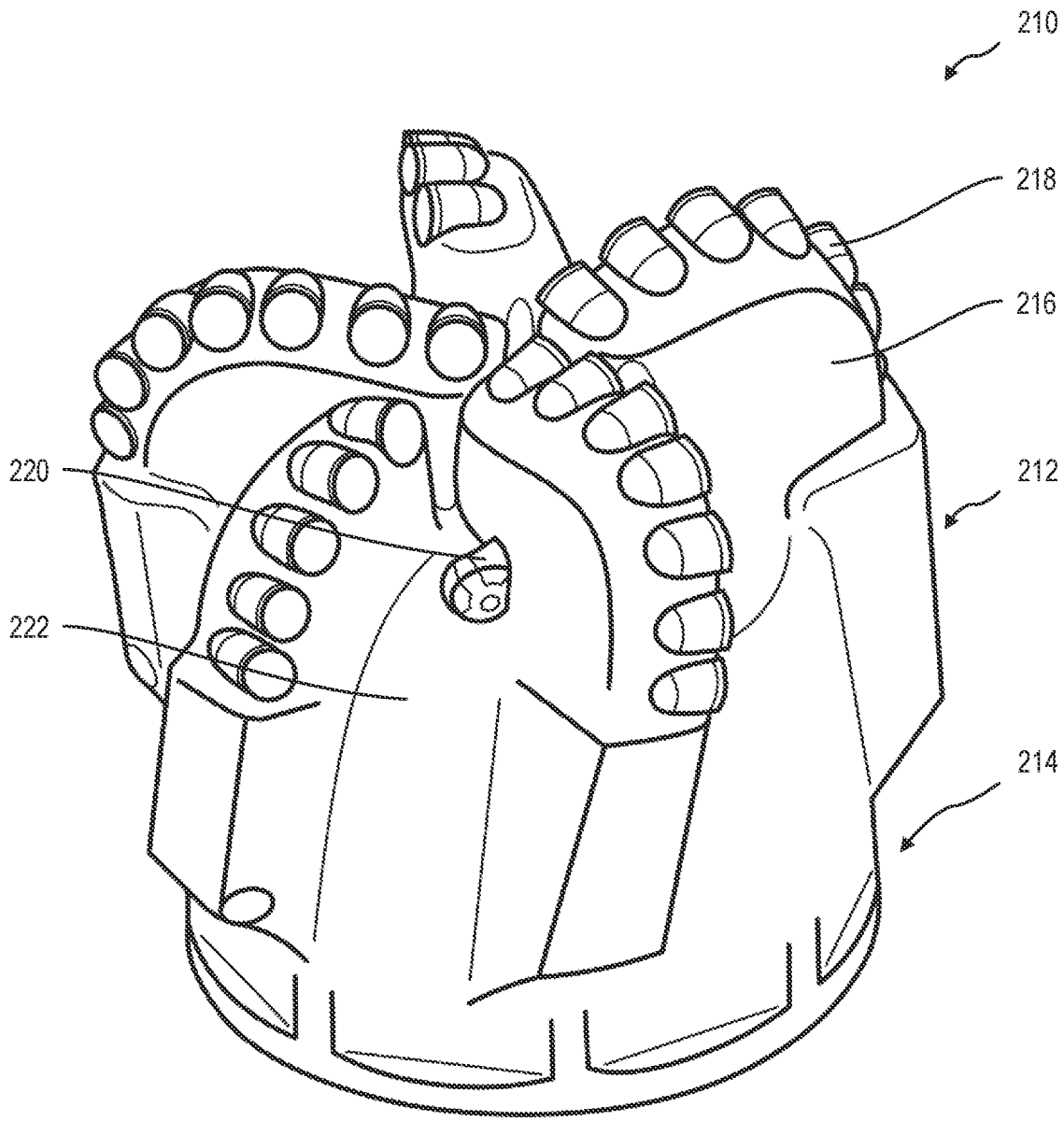
FIG. 2 is a perspective view of a bit, according to at least one embodiment of the present disclosure.

FIG. 2 is a perspective view of a bit 210, according to at least one embodiment of the present disclosure. The bit 210 shown includes a head portion 212 and a connection portion 214 opposite the head portion 212. The head portion 212 includes a plurality of blades 216. The blades 216 include a plurality of cutting elements 218. As the bit 210 rotates, the elements 218 may engage and degrade the formation, thereby advancing the wellbore. Cuttings may be flushed away from the bottom of the wellbore using drilling fluid passed through one or more nozzles 220. The cuttings may be flushed away from the bit 210 through a junk slot 222 between two blades 216.

The connection portion 214 of the bit 210 shown includes a box connection opposite the head portion 212. The connection portion 214 may include a threaded connection on the inner surface of the connection portion 214. The bit 210 may be connected to a drill string and/or a BHA at the box connection of the connection portion 214. In some embodiments, the head portion 212 may be formed from a wear and/or erosion resistant material, such as tungsten carbide. Such materials may be relatively brittle. Operation of a bit formed with only a brittle material forming the connection portion 214 may damage and/or break the bit 210 at or near the connection portion 214 due to the forces applied to the connection portion 214. In some embodiments, one or more cutting elements 218 may be arranged as gauge cutting elements in the connection portion 214 of the bit 210. A bit 210 with the connection portion 214 having a box connection may facilitate arrangement of a gauge cutting element to be axially nearer to the drill string component directly coupled to the bit 210 than a bit with the connection portion having a pin connection. A bit 210 having a connection portion 214 with a box connection may be shorter than a bit having a pin connection. A shorter bit and/or a bit having a gauge cutting element positioned in the connection portion 214 nearer to the drill string component directly uphole of the bit 210 may improve the steering capabilities of the bit 210.

In accordance with at least one embodiment of the present disclosure, the connection portion 214 may include a reinforcing ring. The reinforcing ring may be at least partially embedded within the connection portion 214. The reinforcing ring may strengthen the connection between the bit 210 and the drill string and/or the BHA. For example, the reinforcing ring may be formed from a different material than the head portion 212. In some embodiments, the reinforcing ring may be formed from a material that is more ductile than the material of the head portion 212. The reinforcing ring may be formed from a material that has greater toughness than the material of the head portion 212. This may help to reduce damage to the connection portion 214 during operation. This may result in a longer operating life and/or reduced cost to operate.

Figures 1, 3:
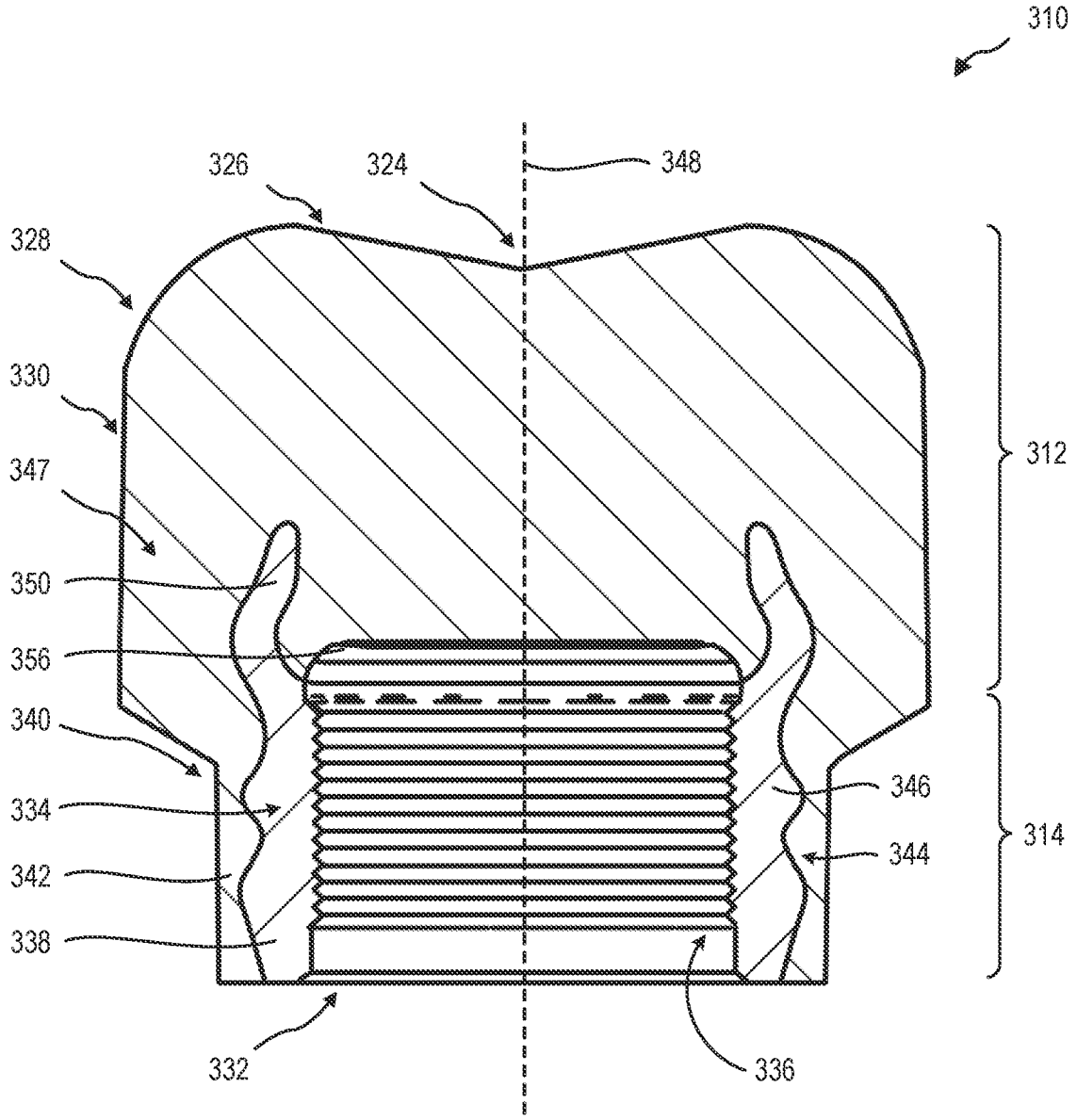
Figures 2, 3:
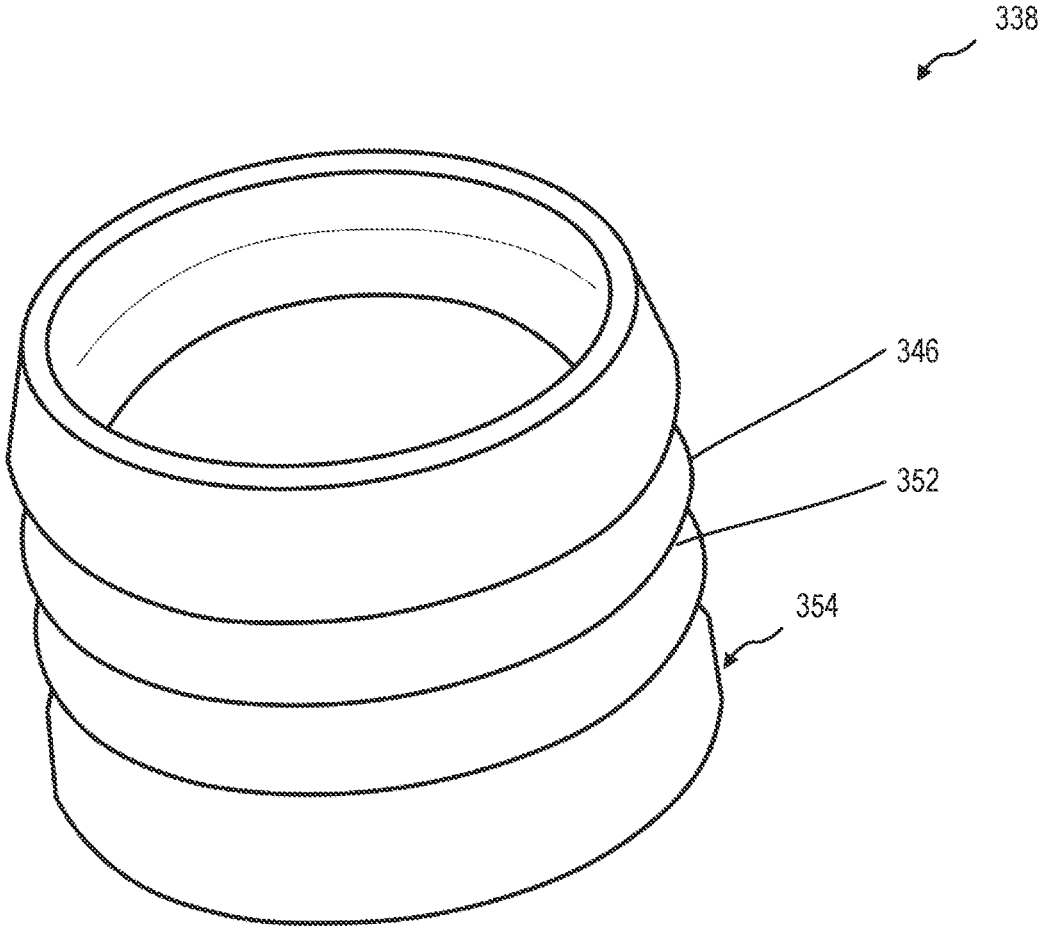

FIG. 3-1 is a schematic cross-sectional view of a bit 310, according to at least one embodiment of the present disclosure. The bit 310 includes a head portion 312 and a connection portion 314. The head portion 312 may include a cone portion 324, a nose portion 326, a shoulder portion 328, and a gauge portion 330. The head portion 312 may be formed from a head material (e.g., a first material). As discussed herein, the head portion 312 may be formed from a wear and/or erosion resistant material. For example, the head portion 312 may be formed from a tungsten carbide (WC) material infiltrated with a binder. The binder may be a nickel-based, cobalt-based, or copper-based binder. In some embodiments, the bit body could be formed of infiltrated matrix including super hard particles such as TiC, natural diamond, synthetic diamond, and combinations thereof. These super hard particles could be in various forms and/or shapes. For example, the super hard particles may include coated layers to protect the particles during infiltration and promote bonding with infiltrant and/or may be pelletized particles or preformed segments. In some embodiments, the head portion 312 may include machined steel or steel alloy.

The connection portion 314 may include a box connection 332. The box connection 332 may include a threaded connection 334 located on an inner surface 336 of the connection portion 314. Conventionally, the connection portion 314, including some or all of the box connection 332 and/or the threaded connection 334 may be formed from the ultrahard material. During operation, the connection portion 314 may be subject to impact and/or shock loading. This may cause the box connection 332, including one or more threads of the threaded connection 334, to fracture or break. This may result in reduced effectiveness of the threaded connection 334. In some situations, this may result in separation of the bit 310 from the drill string and/or the BHA. In some situations, this may result in the head portion 312 shearing or breaking off from the connection portion 314.

In accordance with at least one embodiment of the present disclosure, the connection portion 314 includes a reinforcing ring 338. The reinforcing ring 338 may be configured to strengthen and improve the toughness of the connection portion 314. For example, the reinforcing ring 338 may strengthen the box connection 332. In some examples, the reinforcing ring 338 may strengthen the threaded connection 334. As discussed herein, a conventional threaded connection formed from an infiltrated matrix body may not have sufficient strength and/or toughness for a long-lasting threaded connection. By adding the reinforcing ring 338 in at least one embodiment, the threaded connection to the drill bit and/or the BHA increases the strength and/or longevity of the threaded connection.

In some embodiments, the reinforcing ring 338 is formed from a different material than the head portion 312. For example, the reinforcing ring 338 may be formed from a material that is more ductile than the material that forms the head portion 312. In some embodiments, the reinforcing ring 338 forms at least a portion of the inner surface 336 of the connection portion 314. In some embodiments, the threads of the threaded connection 334 are formed in the reinforcing ring 338. Put another way, the threads of the threaded connection 334 may be formed on the inner surface 336 of the threaded connection 334. The threads of the threaded connection of the reinforcing ring 338 formed from a different material than the head portion 312 may be tougher and more resilient than threads formed from the same material as the head portion 312. As discussed herein, forming the threaded connection 334 on the reinforcing ring 338 may help to improve the connection between the box connection 332 and the pin connection on the drill string and/or the BHA, particularly in comparison to forming the threaded connection 334 from the material of the head portion 312.

In some embodiments, the connection portion 314 includes a head material section 342 and the reinforcing ring 338. For example, in the embodiment shown, the connection portion 314 includes the head material section 342 at an outer surface 340 of the connection portion 314 and the reinforcing ring 338 at the inner surface 336 of the connection portion 314. In this manner, the connection portion 314 may be wear and/or erosion resistant based on the head material and may have a strong box connection 332 based on the ring material of the reinforcing ring 338.

The head material section 342 may be coupled to the reinforcing ring 338 in one or more manners. For example, the head material of the head material section 342 may be directly coupled to the ring material of the reinforcing ring 338. Put another way, the head material of the head material section 342 may be in contact with the reinforcing ring 338. Threads, an interference fit, and/or one or more mechanical fasteners may directly couple the head material section 342 with the reinforcing ring 338. In some embodiments, the head material of the head material section 342 may be adhered to the reinforcing ring 338. For example, the head material of the head material section 342 may include a granular material and an infiltrant. As will be discussed in further detail herein, the head material section 342 may be cast around the reinforcing ring 338. As the infiltrant infiltrates the granular material, the infiltrant may adhere, bond, or stick to the reinforcing ring 338.

In some embodiments, the head material in the connection portion 314 may be continuous between the head portion 312 and the connection portion 314. This may help to strengthen the joint between the connection portion 314 and the head portion 312. In some embodiments, at least a portion of the reinforcing ring 338 may be embedded within the connection portion 314. For example, at least a portion of the reinforcing ring 338 may be embedded in the head material of the connection portion 314. This may help to strengthen the connection between the reinforcing ring 338 and the rest of the bit 310, including the head material in both the connection portion 314 and the head portion 312.

In the embodiment shown, the reinforcing ring 338 may be connected to the connection portion 314 with one or more interlocking features 344. The interlocking features 344 may include an uneven outer ring surface. For example, the outer ring surface may include one or more protrusions, indentations, or other surface features. During casting of the bit 310, the granular material (including granular WC particles) may flow around the one or more interlocking features 344 and the infiltrant may cast the granular material in place around the one or more interlocking features 344. This may help to prevent movement of the reinforcing ring 338 within the connection portion 314, including movement of the reinforcing ring 338 within the head material section 342.

In some embodiments, the one or more interlocking features 344 include any surface feature. For example, the one or more interlocking features 344 may include a circumferential ridge 346. The circumferential ridge 346 may be a protrusion on the reinforcing ring 338 that extends radially from the outer ring surface of the reinforcing ring 338 in a circumferential ring at one or more axial positions of the reinforcing ring 338. The circumferential ridge 346 may be embedded in the connection portion 314. The circumferential ridge 346 may axially overlap with the head material section 342. In some embodiments, the circumferential ridge 346 may help to prevent movement longitudinal movement of the reinforcing ring 338 from the head material section 342 of the connection portion 314, or movement parallel to a rotational axis 348 of the bit 310. In some embodiments, the one or more interlocking features 344 may include one or more rotational locking features. For example, the interlocking features 344 may include one or more surface features that may help to prevent rotation of the reinforcing ring 338 within the head material section 342 of the connection portion 314. For example, the interlocking features 344 may include a radial protrusion from the outer ring surface of the reinforcing ring 338. The protrusion may be oriented parallel to the rotational axis 348 and may circumferentially overlap with the head material section 342. This may help to prevent rotation of the reinforcing ring 338 around the rotational axis 348 within the head material section 342 of the connection portion 314. In some embodiments, the one or more interlocking features 344 may help to prevent rotation and/or longitudinal movement of the reinforcing ring 338 with respect to the head material section 342 of the connection portion 314. For example, the protrusions extending from the outer ring surface of the reinforcing ring 338 may include bumps or détentes on the outer ring surface of the reinforcing ring 338.

In the embodiment shown, the reinforcing ring 338 extends along an entirety of the connection portion 314. In some embodiments, the reinforcing ring 338 may extend through less than an entirety of the connection portion 314, such as less than 95%, less than 90%, or less than 75%. In some embodiments, the reinforcing ring 338 may include an entirety of the threaded connection 334. In some embodiments, the reinforcing ring 338 may include a portion of the threaded connection 334.

In some embodiments, the reinforcing ring 338 may extend into the head portion 312. For example, in the view shown, the reinforcing ring 338 includes a head section 350 that extends into the head material of the head portion 312. This may help to increase the strength of the connection between the head portion 312 and the connection portion 314. In some embodiments, the head section 350 may taper in thickness to reduce the stresses between the head material of the head portion 312 and the reinforcing ring 338. In some embodiments, the head section 350 may extend past a fluid chamber 356 in the head portion 312. The fluid chamber 356 may be fluidly and/or hydraulically connected to the fluid path in the drill string and/or the BHA. The fluid chamber 356 may direct drilling fluid to the various ports and nozzles in the bit 310. Extending the head section 350 past the fluid chamber 356 in the head portion 312 may help to strengthen the head portion 312, including the portion of the head portion 312 that is relatively thin based on the presence of the fluid chamber 356.

In some embodiments, the body 347 of the bit 310 and the reinforcing ring 338 may be separately formed and connected after they are formed. For example, the one or more interlocking features 344 may include a threaded connection, and the body 347 and the reinforcing ring 338 may be threaded together. This may allow for two machined materials to be connected together. For example, the body 347 of the bit 310 and the reinforcing ring 338 may be formed from two different steel alloys or two different grades of steel. The body 347 of the bit 310 may be formed from a hardened steel alloy, such as a tool steel, and the reinforcing ring 338 may be formed from a higher ductility steel alloy. In this manner, the bit 310 may include a steel alloy bit.

FIG. 3-2 is a perspective view of the reinforcing ring 338 of FIG. 3-1. As may be seen, the reinforcing ring 338 includes a plurality of circumferential ridges 346 and circumferential grooves 352 on a outer ring surface 354. During assembly of the bit 310, the reinforcing ring 338 may be placed in a mold and the bit 310 may be cast around the reinforcing ring 338. As may be seen, the circumferential ridge 346 and the circumferential grooves 352 extend around an entirety of the outer surface 354. For example, the circumferential ridge 346 and the circumferential grooves 352 may extend around an entirety of the circumference of the outer surface 354.

Figure 4:
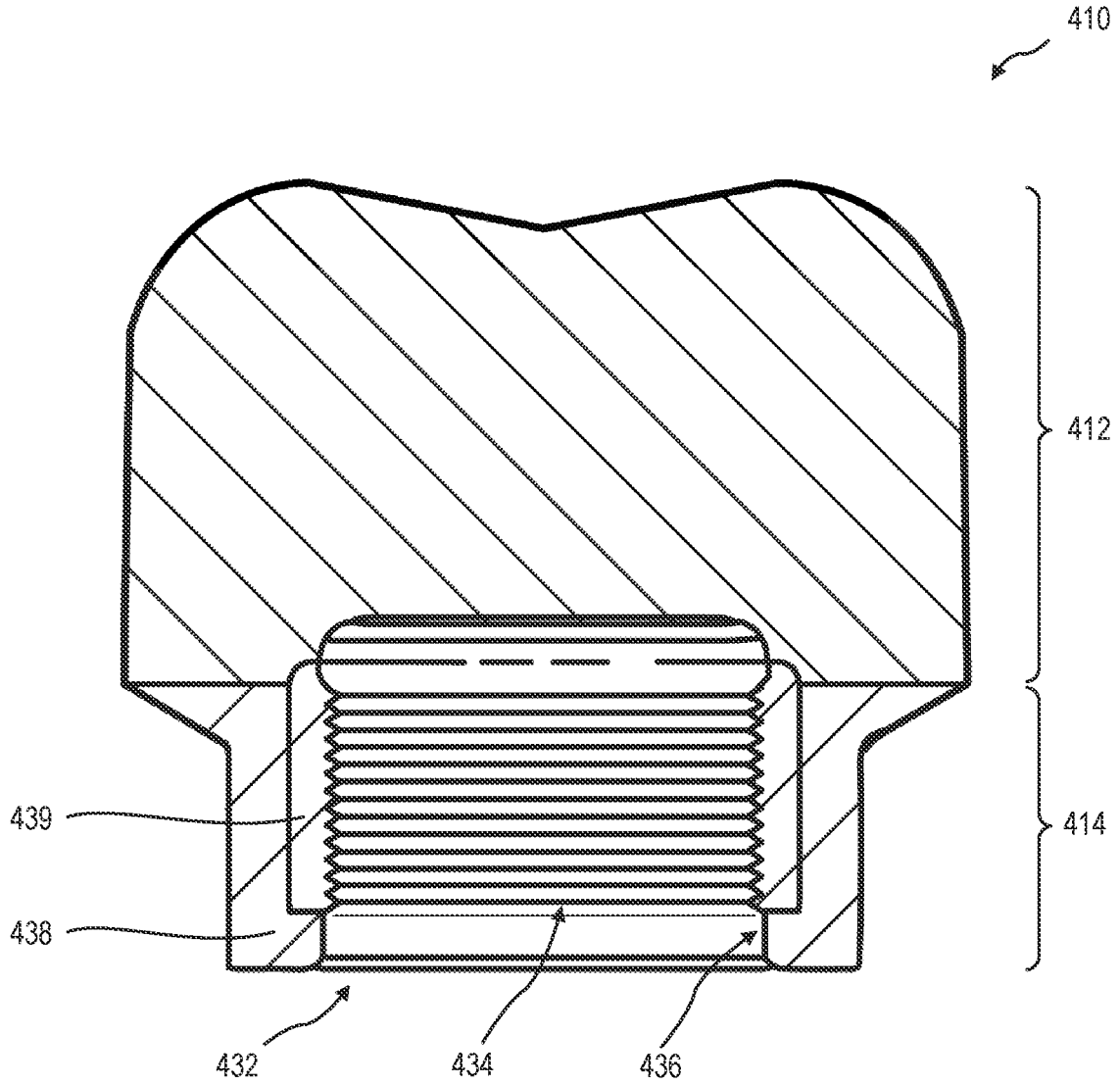
FIG. 4 is a schematic cross-sectional view of a bit having a reinforcing ring located in a connection portion, according to at least one embodiment of the present disclosure.

FIG. 4 is a schematic cross-sectional view of a bit 410 having a reinforcing ring 438 located in a connection portion 414, according to at least one embodiment of the present disclosure. The bit 410 further includes a head portion 412 connected to the connection portion 414. The connection portion 414 includes a box connection 432 having a threaded connection 434 located on an inner surface 436. In some embodiments, the reinforcing ring 438 has a threaded ring 439 at least partially inserted therein to form the threads of the threaded connection 434. The threaded ring 439 may be welded, brazed, mechanically interlocked, press fit, or otherwise coupled to the reinforcing ring 438. The material of the threaded ring 439 may have more ductility than the material of the reinforcing ring 438, which itself has more ductility than the material of the head portion 412.

The reinforcing ring 438 may form an entirety of the connection portion 414 without the threaded ring 439. Put another way, the connection portion 414 may not include any material other than the ring material of the reinforcing ring 438. The reinforcing ring 438 may be connected to the head material of the head portion 412. Forming the entire connection portion 414 from the reinforcing ring 438 may help to strengthen the box connection 432.

Figures 1, 5:
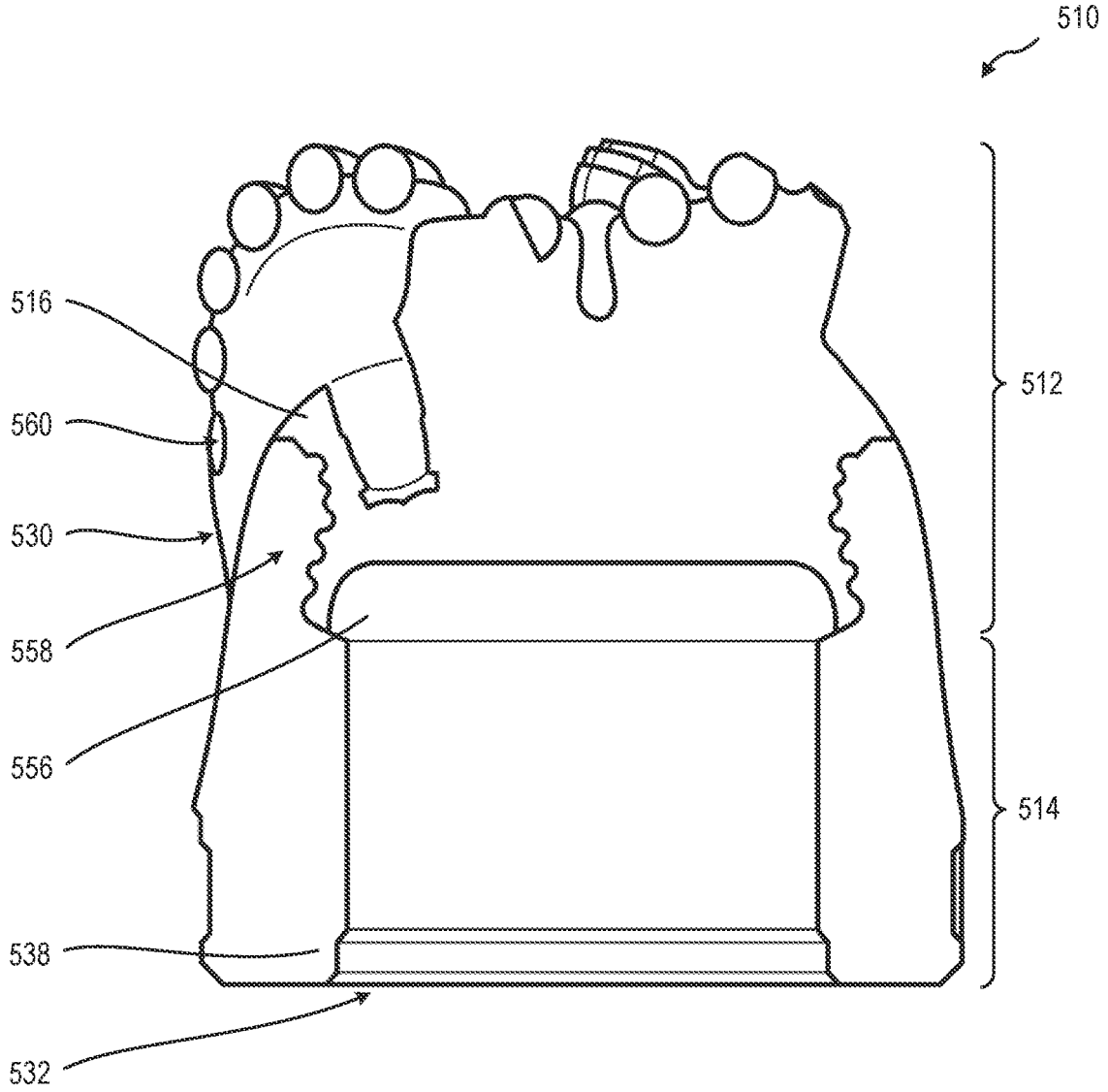
Figures 2, 5:
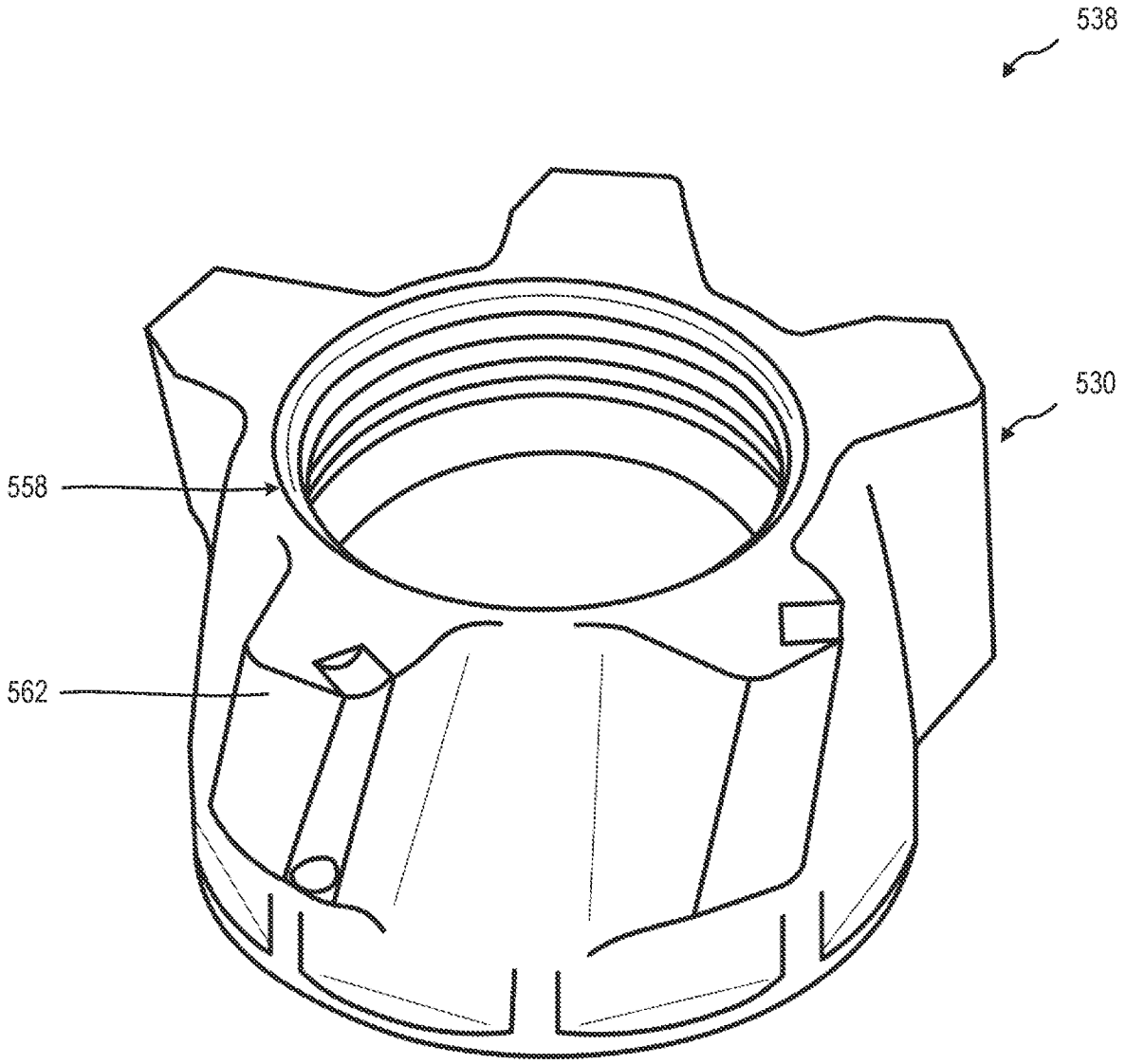

FIG. 5-1 is a schematic cross-sectional view of a bit 510 having a reinforcing ring 538 located in a connection portion 514, according to at least one embodiment of the present disclosure. The bit 510 further includes a head portion 512 connected to the connection portion 514. The connection portion 514 includes a box connection 532. The reinforcing ring 538 may form an entirety of the connection portion 514. Put another way, the connection portion 514 may not include any material or structure other than the reinforcing ring 538. In some embodiments, the reinforcing ring 538 may include the box connection 532 with the internal threads.

In accordance with at least one embodiment of the present disclosure, the reinforcing ring 538 may extend into head portion 512. For example, the reinforcing ring 538 may extend past the boundary between the connection portion 514 and the head portion 512. In some examples, the reinforcing ring 538 extends past a fluid chamber 556 that extends from the drill string to the connection portion 514 and into the head portion 512.

In some embodiments, the reinforcing ring 538 may be connected to the head portion 512 with a ring threaded connection 558 or casted directly so the threading feature, in at least one embodiment, aids the bonding area and/or strength. The ring threaded connection 558 may include ring threads on an upper portion of the reinforcing ring 538 and head threads on an outer surface of the head portion 512. The head portion 512 may be threaded to the reinforcing ring 538, thereby securing the head portion 512 to the reinforcing ring 538.

In some embodiments, the head portion 512 and the reinforcing ring 538 may be separated, based, on the ring threaded connection 558. For example, the head portion 512 may be removed from the reinforcing ring 538 via unthreading the ring threaded connection 558. In this manner, the head portion 512 and/or the reinforcing ring 538 may be repaired and/or replaced. For example, during operation, the head portion 512, including cutting elements or other portions of the head portion 512 may be damaged. To repair the head portion 512, the head portion 512 may be removed from the reinforcing ring 538 and sent to a shop for repair. In some examples, during operation, the connection portion 514 may be damaged while the head portion 512 remains operational. Rather than replace the entire bit 510, the head portion 512 may be removed from the reinforcing ring 538 and a new reinforcing ring 538 may be connected to the head portion 512 using the ring threaded connection 558. This may help to reduce costs of the bit 510 based on damage to the connection portion 514.

In some embodiments, the bit 510 may be modular, or different head portion 512 may be connected to different connection portions 514. For example, a first head portion 512 having a first set of properties, such as pattern of cutting elements, number and layout of blades, diameter, nozzles, and so forth, may be connected to the reinforcing ring 538. Based on changing wellbore conditions (including drilling a new or different wellbore with the same bit 510), the head portion 512 may be disconnected from the reinforcing ring 538 and a second head portion 512 having a different set of properties may be connected to the reinforcing ring 538. In this manner, the bit 510 may be prepared based on the relevant drilling conditions.

In some embodiments, the reinforcing ring 538 may extend into a gauge portion 530 of a blade 516 of the head portion 512. For example, the reinforcing ring 538 may extend into the head portion 512 and may comprise or extend into one or more of the blades 516. In some embodiments, the reinforcing ring 538 may include one or more gauge cutting elements 560 in the gauge portion 530. Extending the reinforcing ring 538 into the gauge portion 530 may provide improved control over the gauge diameter and/or positioning of the one or more gauge cutting elements 560.

In some embodiments, as discussed herein, the head portion 512 and the reinforcing ring 538 may be formed from two machinable materials. For example, the head portion 512 and the reinforcing ring 538 may be formed from two different steel alloys. The body of the head portion 512 may be formed from a hardened steel alloy, such as tool steel, and the reinforcing ring 538 may be formed from a more ductile steel alloy.

FIG. 5-2 is a perspective view of the reinforcing ring 538 of FIG. 5-1 with the head portion 512 disconnected from the reinforcing ring 538. As may be seen, the reinforcing ring 538 includes internal ring threads of a reinforcing ring 538. As discussed herein, this may allow the reinforcing ring 538 to be removed from the head portion 512 for replacement of the reinforcing ring 538 and/or the head portion 512.

In some embodiments, the reinforcing ring 538 is cast directly to the granular material of the head portion 512. In at least one embodiment, the casting of the reinforcing ring 538 to the WC granular material (or others mentioned above) may help improve the connection at the threads or other interlocking features of the reinforcing ring 538.

The reinforcing ring 538 may further include blade extensions 562. The blade extensions 562 may be oriented with the same spacing and orientation as the blades 516 on the head portion 512. The blade extensions 562 may include some or all of the gauge portion 530 of the bit 510. This may allow the reinforcing ring 538 to help maintain the gauge diameter of the wellbore. In this manner, the blade extensions 562 of the reinforcing ring 538 may help to improve operation of the bit 510.

Figures 1, 6:
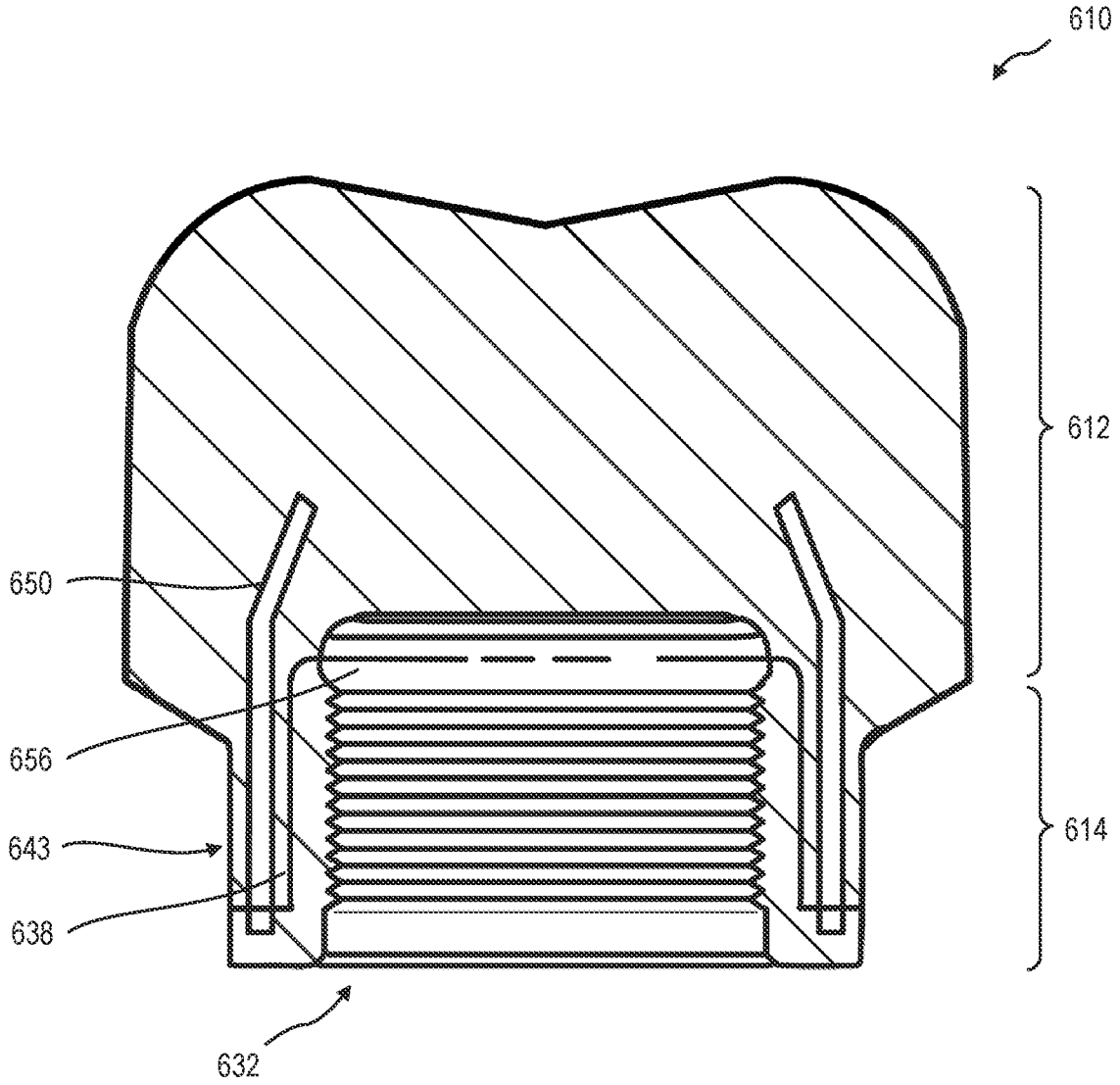
Figures 2, 6:
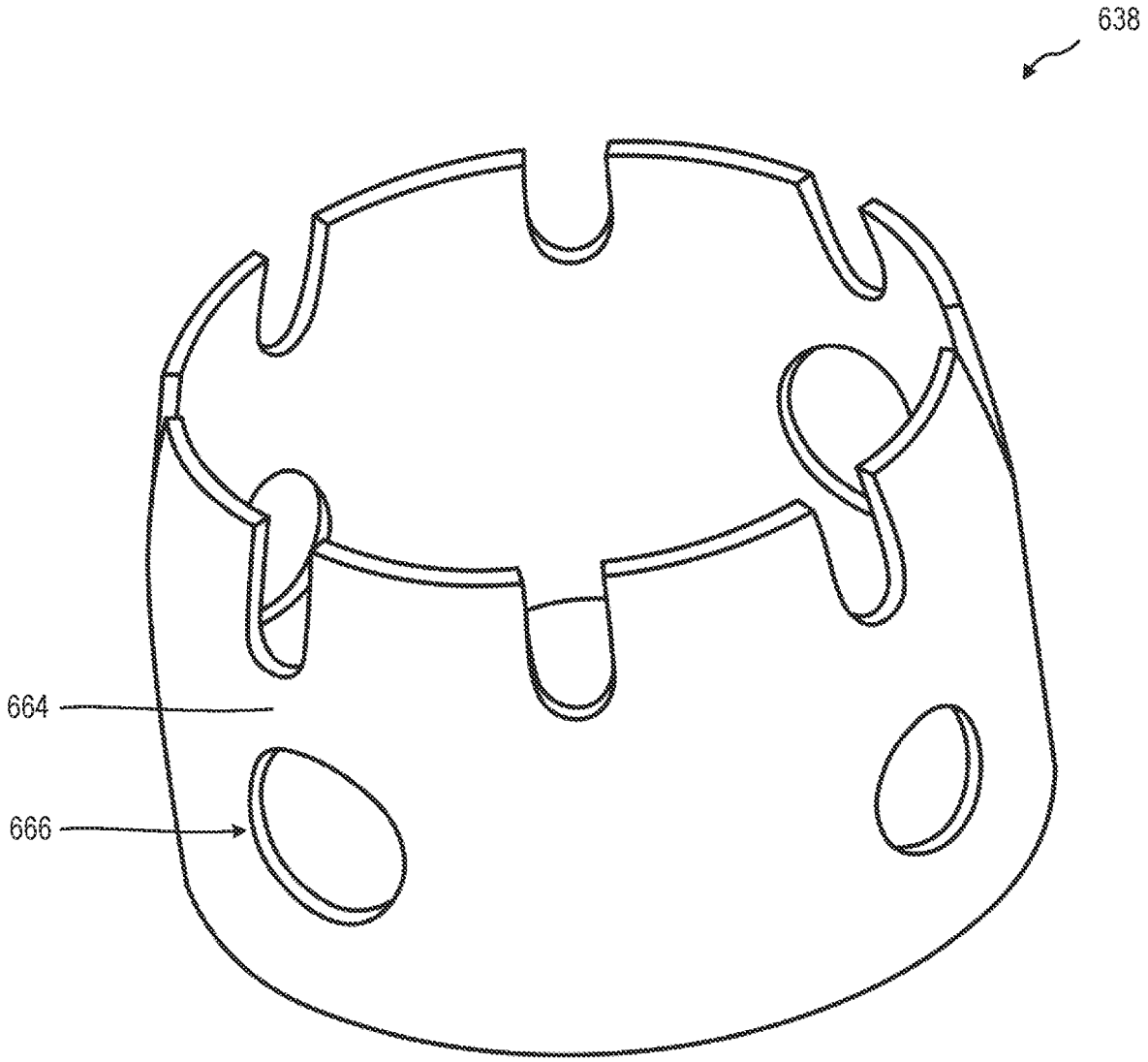

FIG. 6-1 is a representation of a bit 610 having a reinforcing ring 638 embedded within head material thereof, according to at least one embodiment of the present disclosure. The bit 610 includes a head portion 612 and a connection portion 614 connected to the head portion 612. In some embodiments, the head portion 612 may be formed from a head material, such as an ultrahard material. The connection portion 614 may include the head material. In some embodiments, the head portion 612 and the connection portion 614 may be formed from a monolithic portion of the head material. For example, the head material may include a granular material infiltrated by an infiltrant. The granular material may be infiltrated in a single portion between the head portion 612 and the connection portion 614.

The reinforcing ring 638 may be embedded within the connection portion 614. In some embodiments, the reinforcing ring 638 may be located within the connection portion 614 and the head material may be formed or solidified around an entirety of the reinforcing ring 638. No portion of the reinforcing ring 638 may be exposed or extend outside of the boundaries of the bit 610.

In some embodiments, the reinforcing ring 638 may be located at the connection portion 614. The reinforcing ring 638 may help to increase the strength of connection portion 614. For example, as discussed herein, the reinforcing ring 638 may be formed from a more ductile material than the head material. This may help to increase the strength of the connection portion 614, and in particular the strength of the connection portion 614 when subjected to lateral and shearing forces.

The connection portion 614 may include a box connection 632. In the embodiment shown, the box connection 632 may be formed from the head material. The reinforcing ring 638 may be located between the threads of the box connection 632 and the outer surface 643 of the connection portion 614. This may help to increase the strength of the box connection 632.

In the embodiment shown, the reinforcing ring 638 extends into the head portion 612. As discussed herein, extending the reinforcing ring 638 into the head portion 612 may help to improve the connection between the head portion 612 and the connection portion 614. This may help to prevent shearing or other separation of the head portion 612 from the connection portion 614, thereby reducing or preventing damage to the bit 610.

In some embodiments, the reinforcing ring 638 may extend into the head portion 612. For example, in the view shown, the reinforcing ring 638 includes a head section 650 that extends into the head material of the head portion 612. This may help to increase the strength of the connection between the head portion 612 and the connection portion 614. In some embodiments, the head section 650 may taper in thickness and/or diameter to reduce the stresses between the head material of the head portion 612 and the reinforcing ring 638. In some embodiments, the head section 650 may axially extend past a fluid chamber 656 in the head portion 612. The fluid chamber 656 may be fluidly and/or hydraulically connected to the fluid path in the drill string and/or the BHA. The fluid chamber 656 may direct drilling fluid to the various ports and nozzles in the bit 610. Extending the head section 650 past the fluid chamber 656 in the head portion 612 may help to strengthen the head portion 612, including the portion of the head portion 612 that is relatively thin based on the presence of the fluid chamber 656.

FIG. 6-2 is a perspective view of the reinforcing ring 638 of FIG. 6-1 without the head material of the bit 610 surrounding the reinforcing ring 638. The reinforcing ring 638 includes a body 664. The reinforcing ring 638 may further include one or more thermal mismatch holes 666. During casting, granular material may flow into the thermal mismatch holes 666, and the infiltrant may bind the granular material in the thermal mismatch holes 666. During infiltration, the body 664, the granular material, and the infiltrant may be heated up. Each of the body 664, the granular material, and the infiltrant may have a different coefficient of thermal expansion. As the cast bit 610 cools, the thermal mismatch holes 666 may help to alleviate internal stresses in the bit 610 caused by the different coefficients of thermal expansion of the cooling material. Moreover, infiltration through the thermal mismatch holes 666 interlocks the reinforcing ring 638 with head material of the bit 610.

Figure 7:
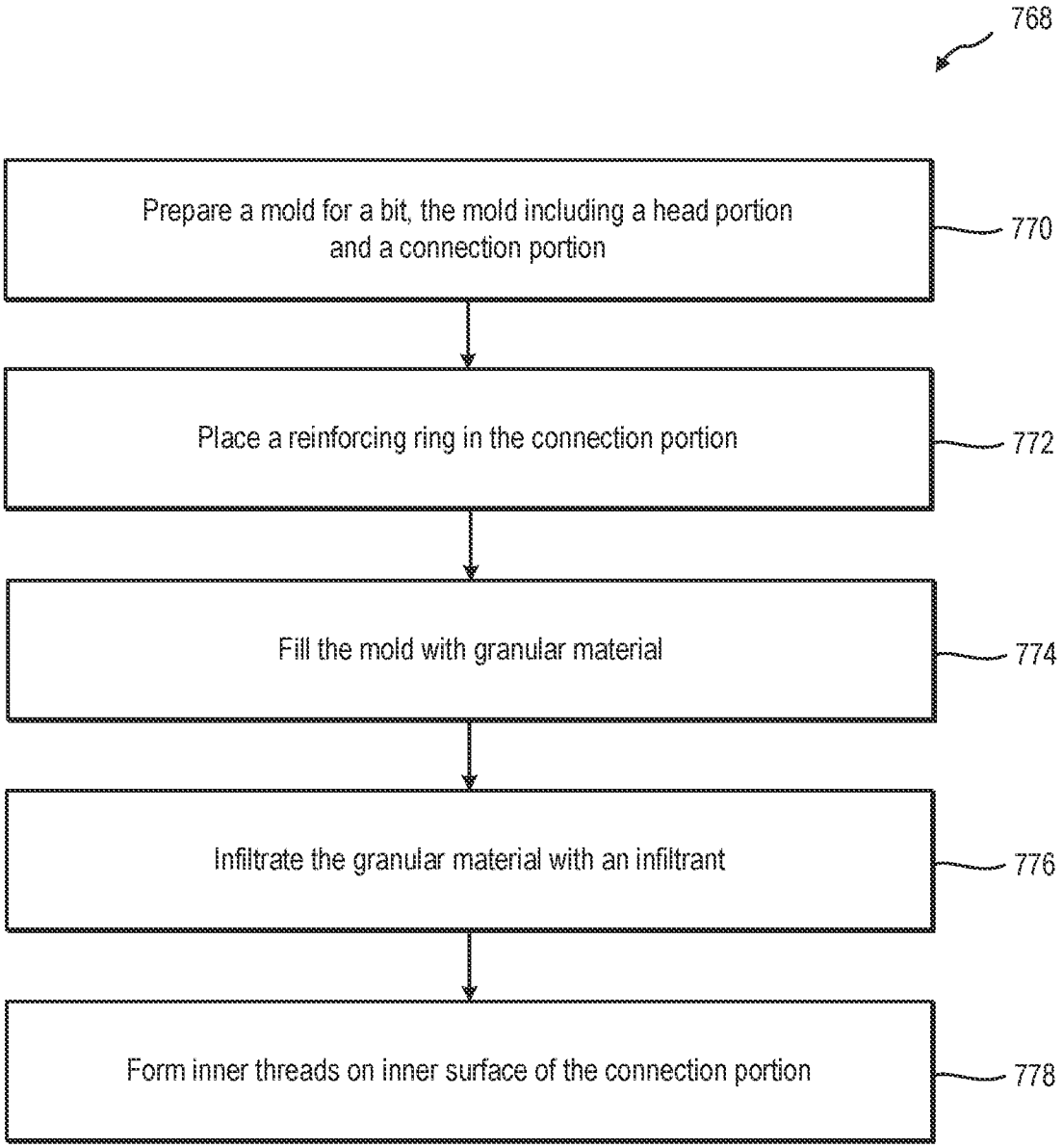
FIG. 7 is a flowchart of a method for manufacturing a bit, according to at least one embodiment of the present disclosure.

FIG. 7, the corresponding text, and the examples provide a number of different methods for manufacturing a bit. In addition to the foregoing, one or more embodiments can also be described in terms of flowcharts comprising acts for accomplishing a particular result, as shown in FIG. 7. FIG. 7 may be performed with more or fewer acts. Further, the acts may be performed in differing orders. Additionally, the acts described herein may be repeated or performed in parallel with one another or parallel with different instances of the same or similar acts.

As mentioned, FIG. 7 illustrates a flowchart of a method 768 or a series of acts for manufacturing a bit in accordance with one or more embodiments. While FIG. 7 illustrates acts according to one embodiment, alternative embodiments may omit, add to, reorder, and/or modify any of the acts shown in FIG. 7. The acts of FIG. 7 can be performed as part of a method.

The method 768 may include preparing a mold for a bit at 770. The mold may be any type of mold. For example, the mold may include a negative impression of a shape of the bit. Preparing the mold, when the granular material is poured into the mold and infiltrated, the infiltrated material may be formed into the shape of the bit. The mold may include a head portion with a negative impression of the shape of the head. For example, the head portion may include one or more blades, cutting element pockets, junk slots, hydraulic paths, sockets for insertion of a nozzle, any other bit head shape, and combinations thereof. The mold may further include a connection portion. The connection portion may include a location for a threaded connection for connection to a drill string and/or a BHA.

A reinforcing ring may be placed in the connection portion at 772. The reinforcing ring may be any type or form of reinforcing ring discussed herein. In some embodiments, as discussed herein, the reinforcing ring may be placed in the connection portion to form the box connection. The reinforcing ring may include inner threads on an inner surface thereof. In some embodiments, the inner threads are formed on the inner surface prior to arranging the reinforcing ring in the connection portion. In some embodiments, the inner threads are formed on the inner surface after the reinforcing ring is secured and interlocked with the body of the bit. In some embodiments, the reinforcing ring may form an entirety of the connection portion. Put another way, when the reinforcing ring is placed in the mold, the reinforcing ring may fill an entirety of the connection portion of the mold. In some embodiments, the reinforcing ring may not fill an entirety of the connection portion of the mold. For example, the reinforcing ring may not extend to an inner surface of the mold (which may correspond to an outer surface of the connection portion of the formed bit). As discussed in further detail herein, this may allow the head material to be formed around the outer surface of the reinforcing ring. In some embodiments, the reinforcing ring may be secured to the mold so that the reinforcing ring does not move during casting of the bit.

With the reinforcing ring placed in the mold, the mold may be filled with a granular material at 774. The granular material may be any type of granular material, such as tungsten carbide particles or any other type of ultrahard particles. In some embodiments, the granular material may be a flowable granular material. The granular material may be flowed into the mold. The granular material may flow around the reinforcing ring. For example, the granular material may flow around any interlocking features, thermal mismatch holes, protrusions, detents, or other surface features on the reinforcing ring. In some embodiments, while filling the mold with a granular material, the granular material may come into contact with or engage the reinforcing ring. In some embodiments, filling the mold with the granular material may include filling the head portion and the connection portion with the granular material. In some embodiments, filling the mold with the granular material may include filling the connection portion of the mold around the reinforcing ring.

After the mold is filled with the granular material, the granular material may be infiltrated with an infiltrant at 776. To infiltrate the granular material, an infiltrant, such as a nickel-based or copper-based binder, may be heated to its melting point. The melting point of the infiltrant may be less than the melting point of the granular material. In this manner, the infiltrant may flow through the voids between grains in the granular material. As the infiltrant cools, the solidified infiltrant may bind the grains of the granular material together, thereby forming a monolithic solid (e.g., a solid without joints or connections between different sections).

In some embodiments, the infiltrant may contact the reinforcing ring and the granular material. When the infiltrant cools, the solidified infiltrant and granular material may secure the reinforcing ring to the body of the bit. In this manner, the reinforcing ring may be cast in the bit. In some embodiments, the reinforcing ring may be connected or secured to the body of the bit with one or more interlocking features. The interlocking features may prevent removal of the reinforcing ring from the body of the bit. In some embodiments, an interlocking feature may prevent removal of the reinforcing ring from the body of the bit without fracture and/or plastic deformation of one or both of the reinforcing ring or the body of the bit. Put another way, with the one or more interlocking features, the reinforcing ring cannot be removed without fracturing or plastically deforming one or both of the reinforcing ring or the body of the bit due to overlapping features of the reinforcing ring and body of the bit. In this manner, the one or more interlocking features between the reinforcing ring and the bit may secure the reinforcing ring to the bit in a manner that may stand up to harsh downhole conditions.

Optionally, the inner threads may be formed on the inner surface of the connection portion at 778 after infiltration of the granular material at 776. After infiltration at 776, the reinforcing ring may be secured in place to facilitate the formation of the inner threads on the inner surface of the reinforcing ring. In some embodiments with the reinforcing ring entirely embedded within the infiltrated material, the inner threads may be formed on the inner surface of the infiltrated material. Forming the inner threads on the inner surface at 778 after joining the reinforcing ring with the connection portion may reduce or eliminate heat effects from the infiltration or joining of components of the bit.

While embodiments of the present disclosure have discussed casting the reinforcing ring in the bit, it should be understood that the bit may be formed in any other manner. For example, the reinforcing ring may be separately formed from the bit head. The separately formed reinforcing ring and the bit head may then be later connected in a modular fashion. In some examples, the bit may be formed using additive manufacturing. For example, an additive manufactured bit may be formed from two different materials. This may allow for complex and custom structures to be easily and efficiently built.

The embodiments of the reinforcing rings have been primarily described with reference to wellbore drilling operations; the reinforcing rings described herein may be used in applications other than the drilling of a wellbore. In other embodiments, reinforcing rings according to the present disclosure may be used outside a wellbore or other downhole environment used for the exploration or production of natural resources. For instance, reinforcing rings of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A bit, comprising:

a bit head formed from a first material;

a connection portion connected to the bit head having a box connection opposite the bit head, wherein the box connection comprises an inner surface having a threaded connection for connection to a drill string; and a reinforcing ring formed from a second material, the reinforcing ring at least partially embedded in the connection portion to strengthen the connection portion and extending axially into the bit head past the box connection, wherein the reinforcing ring is connected to the connection portion with one or more interlocking features.

2. The bit of claim 1, wherein the connection portion includes the first material, the first material being connected to an outer surface of the reinforcing ring.

3. The bit of claim 1, wherein the one or more interlocking features include a circumferential ring embedded in the connection portion.

4. The bit of claim 1, wherein an entirety of the reinforcing ring is embedded within the first material in the connection portion.

5. The bit of claim 1, wherein the reinforcing ring forms the inner surface of the box connection.

6. The bit of claim 5, wherein the second material includes a steel alloy.

7. The bit of claim 1, wherein the first material includes a first steel alloy, and wherein the second material includes a second steel alloy that is more ductile than the first steel alloy.

8. The bit of claim 1, wherein the reinforcing ring forms an entirety of the connection portion.

9. The bit of claim 8, wherein a head section of the reinforcing ring extends into the bit head.

10. A bit, comprising:

a bit head formed from a first material;

a connection portion including threads connected to the bit head; and a reinforcing ring in the connection portion to strengthen the connection portion and extending axially into the bit head past the connection portion, the reinforcing ring formed from a second material, the reinforcing ring forming an inner surface having a threaded connection, the connection portion including the first material on at least a portion of an outer surface of the reinforcing ring.

11. The bit of claim 10, wherein the connection portion includes the first material on an entirety of the outer surface of the reinforcing ring.

12. The bit of claim 10, wherein the reinforcing ring includes an interlocking feature embedded in the first material such that the reinforcing ring cannot be removed without fracturing one or both of the reinforcing ring or the first material.

13. The bit of claim 12, wherein the interlocking feature includes a radial protrusion extending from the outer surface of the reinforcing ring.

14. The bit of claim 12, wherein the reinforcing ring axially extends past a fluid chamber in the bit head.

* * * * *